United States Patent [19]

Kobayashi et al.

[11] Patent Number: 4,489,696

[45] Date of Patent: Dec. 25, 1984

[54] METHOD AND APPARATUS FOR CONTROLLING THE FUEL-FEEDING RATE OF AN INTERNAL COMBUSTION ENGINE

[75] Inventors: Nobuyuki Kobayashi, Toyota; Hiroshi Itoh, Nagoya; Takashi Hattori, Toyota, all of Japan

[73] Assignee: Toyota Jidosha Kabushiki Kaisha, Toyota, Japan

[21] Appl. No.: 407,563

[22] Filed: Aug. 12, 1982

[30] Foreign Application Priority Data

Aug. 13, 1981 [JP] Japan ..... 56/125990

[51] Int. Cl.[3] ..... F02D 5/00

[52] U.S. Cl. ..... 123/493; 123/491

[58] Field of Search ..... 123/493, 491, 480, 486

[56] References Cited

U.S. PATENT DOCUMENTS

| | | | |
|---|---|---|---|
| 4,062,328 | 12/1977 | Konno | 123/493 |
| 4,112,879 | 9/1978 | Assenheimer et al. | 123/493 |
| 4,184,458 | 1/1980 | Aoki et al. | 123/493 |
| 4,245,605 | 1/1981 | Rice et al. | 123/493 |
| 4,257,377 | 3/1981 | Kinugawa et al. | 123/493 |
| 4,359,993 | 11/1982 | Carlson | 123/493 |

*Primary Examiner*—Andrew M. Dolinar

*Attorney, Agent, or Firm*—Cushman, Darby & Cushman

[57] ABSTRACT

The feeding rate of fuel supplied to an internal combustion engine is changed by a quantity depending upon the variation rate of the engine load when the engine is decelerating. Thus, the fuel-feeding rate during deceleration can be controlled to an optimum value, causing fuel consumption and engine response to improve.

14 Claims, 9 Drawing Figures

30
62
MPU
68
RAM
70
ROM
66
I/O
26
FUEL-INJECTION VALVE
72
60
ADC
64
I/O
63
COMPARATOR
40
18
AIR-FLOW SENSOR
48
COOLANT-TEMPERATURE SENSOR
46
38
36
O2 SENSOR
42
44
CRANK-ANGLE SENSOR
43
45
CRANK-ANGLE SENSOR
50
52
VEHICLE-SPEED SENSOR
54
56
NEUTRAL SWITCH

METHOD AND APPARATUS FOR CONTROLLING THE FUEL-FEEDING RATE OF AN INTERNAL COMBUSTION ENGINE

BACKGROUND OF THE INVENTION

The present invention relates to a method and apparatus for controlling the feeding rate of fuel supplied to an internal combustion engine.

It is a well-known practice to provide an internal combustion engine with an electrically fuel-feeding rate control system. Such system calculates the fuel-feeding rate in response to the engine's operating parameters, i.e., the intake-air flow rate and engine-rotational speed, and controls the feeding rate of fuel supplied to the engine from electrical fuel-injection valves or from an electrically controlled carburetor in accordance with the calculated feeding rate.

In such a control system, when the engine is decelerating, the fuel-feeding rate is always decreased by a predetermined constant value irrespective of the change in the engine operating condition. Therefore, according to the conventional control system, optimum fuel control during deceleration cannot be expected.

Suppose the fuel-feeding rate control system has an air-fuel ratio (A/F) closed-loop device for correcting the fuel-feeding rate depending upon an oxygen concentration sensor ($O_2$ sensor). If an engine having such a system is decelerated, since the amount of decrement of the fuel-feeding rate due to deceleration is always constant and fuel adhered to the inner wall of the intake passage is vaporized, the air-fuel mixture in the engine becomes too rich for a while, causing the emission control performance of the catalytic converter to deterorate. Then the A/F of the mixture is controlled to a desired value by the A/F closed-control operation. Namely, according to the A/F closed-loop control operation, the correction factor of the fuel-feeding rate is changed to a value by which the fuel-feeding rate is greatly decreased. During this condition where the correction factor of closed-loop control is maintained at a value by which the fuel-feeding rate is greatly decreased, if the engine is accelerated, since the correction factor cannot be quickly changed in response to the change in the engine's operating condition, sluggish acceleration and backfiring occur.

SUMMARY OF THE INVENTION

It is, therefore, an object of the present invention to provide a method and apparatus for controlling the fuel-feeding rate of an internal combustion engine whereby optimum fuel control during deceleration can be executed, causing both the fuel consumption and the engine response to improve.

According to the present invention, the feeding rate of fuel supplied to an internal combustion engine is changed by a quantity depending upon the variation rate of the engine load when the engine is decelerating.

The above and other related objects and features of the present invention will be apparent from the description of the present invention set forth below, with reference to the accompanying drawings, as well as from the appended claims.

BRIEF DESCRIPTION OF THE DRAWINGS

FIGS. 3, 4, 4A, 4B and 5 are flow diagrams of control programs according to the present invention;

DETAILED DESCRIPTION OF THE PREFERRED EMBODIMENT

Figure 1:
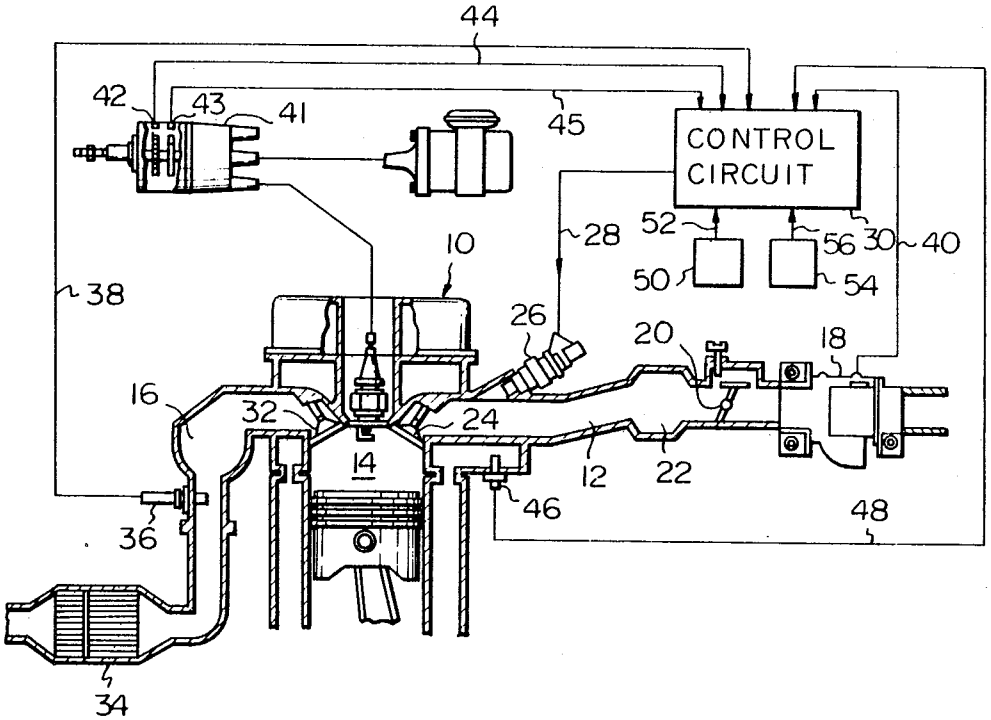
FIG. 1 is a shcematic diagram illustratng an A/F control system of an internal combustion engine in which the present invention is used.

In FIG. 1, reference numeral 10 denotes an engine body, 12 an intake passage, 14 a combustion chamber, and 16 an exhaust passage. The flow rate of intake air introduced through an air cleaner, which is not shown, is measured by an air-flow sensor 18. The intake-air flow rate is controlled by a throttle valve 20 interlocked with an accelerator pedal which is not shown. The intake air passing through the throttle valve 20 is introduced into the combustion chamber 14 via a surge tank 22 and an intake valve 24.

Each of fuel-injection valves 26 for the respective cylinders is opened and closed in response to electrical drive pulses that are fed from a control circuit 30 via a line 28. The fuel-injection valves 26 intermittently inject into the intake passage 12 in the vicinity of the intake valve 24 compressed fuel that is supplied from a fuel supply system which is not shown.

The exhaust gas which is produced due to combustion in the combustion chamber 14 is emitted via an exhaust valve 32, the exhaust passage 16, and a catalytic converter 34.

An oxygen sensor 36 mounted on the exhaust passage 16 detects the concentration of the oxygen component in the exhaust gas and produces a detection signal depending upon the detected concentration. The detection signal from the $O_2$ sensor 36 is fed to the control circuit 30 via a line 38.

The air-flow sensor 18 is mounted in the intake passage 12 at a position upstream of the throttle valve 20 to detect the intake-air flow rate. The detection signal from the air-flow sensor 18 is fed to the control circuit 30 via a line 40.

Crank-angle sensor 42 and 43 disposed in a distributor 41 produce pulse signals at every crank angle of 30° and 720°, respectively. The pulse signals produced at every crank angle of 30° are fed to the control circuit 30 via a line 44, and the pulse signals produced at every crank angle of 720° are fed to the control circuit 30 via a line 45.

A coolant-temperature sensor 46 detects the temperature of the coolant in the engine. The output signal from the coolant-temperature sensor 46 is fed to the control circuit 30 via a line 48.

A vehicle-speed sensor 50 is composed of a reed switch and a rotatable permanent magnet. The magnet is connected to a speedometer cable. Which is not shown, and is rotated thereby for changing the magnetic flux applied to the reed switch. Thus, the reed switch is turned on and off.and generates pulse signals in response to the change in the magnetic flux. The pulse signals from the reed switch are fed to the control circuit 30 via a line 52.

The neutral switch 54 detects whether the shift position of an atuomatic transmission, which is not shown, is selected in a drive range or a neutral range. The output signal from the neutral switch 54 is fed to the control circuit 30 via a line 56.

Figure 2:
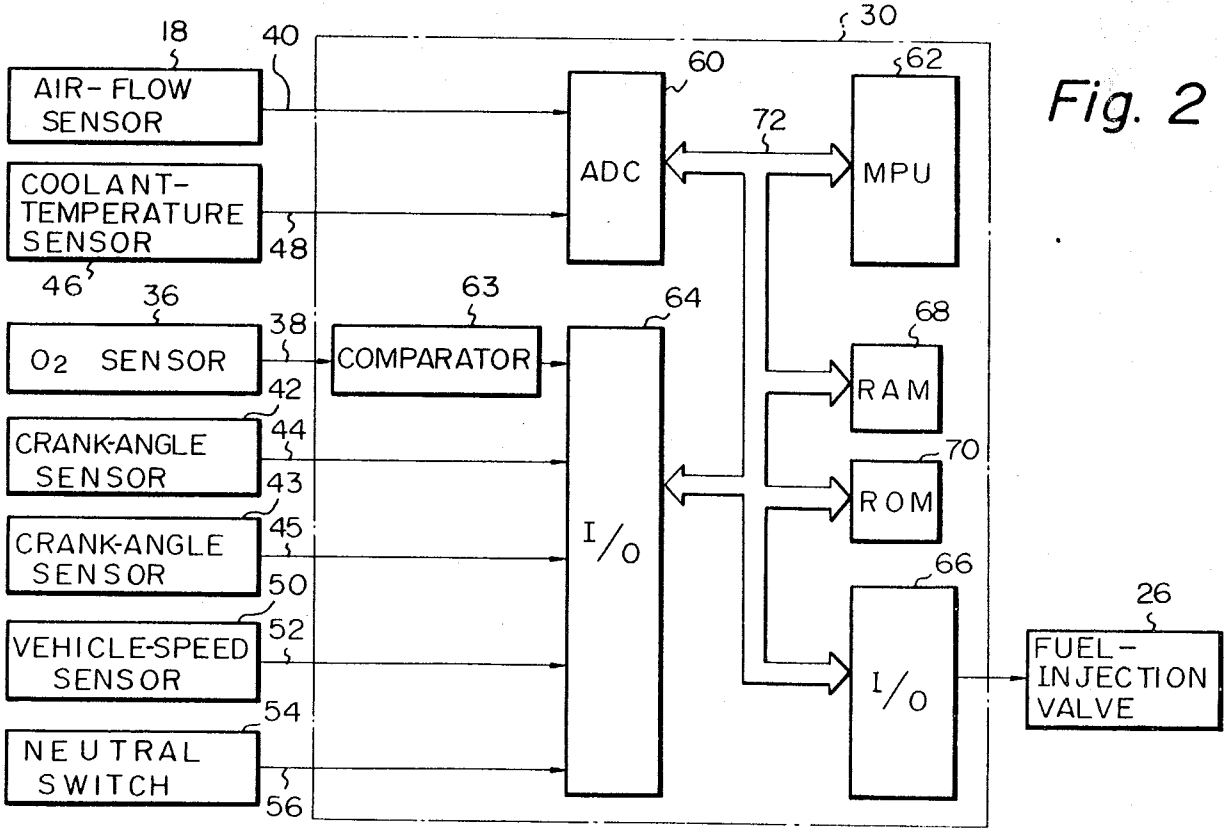
FIG. 2 is a block diagram illustrating the .control circuit shown in FIG. 1.

FIG. 2 illustrates an embodiment of the control circuit 30 shown in FIG. 1. In FIG. 2, the air-flow sensor 18, coolant-temperature sensor 46, $O_2$ sensor 36, crank-angle sensors 42 and 43, vehicle-speed sensor 50, neutral switch 54, and fuel-injection valve 26 for each cylinder are represented by blocks, respectively.

Signals from the air-flow sensor 18 and the coolant-temperature sensor 46 are fed to an analog-to-digital (A/D) converter 60, which contains an analog multiplexer, and are sequentially converted into signals in the form of binary numbers in response to instructions from a microprocessor (MPU) 62.

The detection signal from the $O_2$ sensor 36 is fed to a comparator 63 and is compared with a reference signal. The comparator 63 produces and A/F signal of "1" when the air-fuel mixture in the engine is on the rich side with respect to the stoichiometric condition ($A/F \simeq 14.6$) and produces an A/F signal of "0" when the air-fuel mixture is on the lean side. The A/F signal from the comparator 63 is fed to an input-output (I/O) circuit 64.

The pulse signals produced by the crank-angle sensor 42 at every crank angle of 30° are fed to the MPU 62 via the I/O circuit 64 as interrupt-request signals from the interruption routine of every 30° crank angle. The pulse signals from the crank-angle sensor 42 are further fed to a timing counter, which is disposed in the I/O circuit 64, as counting pulses. The pulse signals produced by the crank-angle sensor 43 at every crank angle of 720° are used as reset pulses of the above timing counter.

In an I/O circuit 66, a register which receives output data corresponding to a fuel-injection pulse width of $\tau$ from the MPU 62, a binary counter which starts the counting operation with respect to clock pulses when fuel-injection initiation pulses are fed from, the I/O circuit 64 to the binary counter, a binary comparator for comparing the contents in the above register and binary counter, and a driver are provided. The binary comparator produces an injection pulse signal of "1" level from the time when the fuel-injection initiation pulse is supplied thereto until the contents in the binary counter coincide with the contents in the register. Therefore, the injection pulse signal produced by the binary comparator has a pulse width of $\tau$. The injection pulse signal is fed to the fuel-injection valve 26 via the driver. The fuel-injection valve 26 thus injects into the engine a quantity of fuel corresponding to the pulse width of $\tau$ of the injection pulse signal.

The pulse signals from the vehicle-speed sensor 50 are applied to a vehicle-speed signal former provided in the I/O circuit 64. The vehicle-speed signal former produces a vehicle-speed signal in the form of binary numbers depending upon the frequency of the pulse signals from the vehicle-speed sensor 50.

The output signal of one bit form the neutral switch 54 is temporarily stored in the I/O circuit 64.

The A/D converter 60 and I/O circuits 64 and 66 are connected via a bus 72 to the MPU 62, a random access memory (RAM) 68, and a read only memory (ROM) 70 which constitute the microcomputer. The data are transferred via the bus 72.

Figure 6:
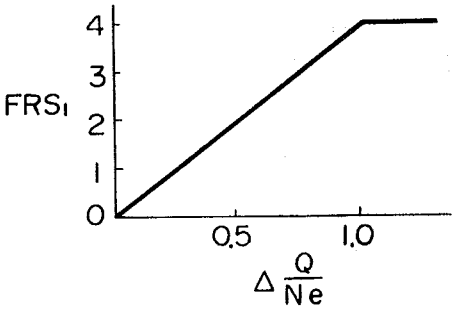
FIG. 6 is a graph of the first coefficient $FRS_1$ of the decrement factor versus the variation rate $\Delta Q/Ne$ of volumetric efficiency.
Figure 7:
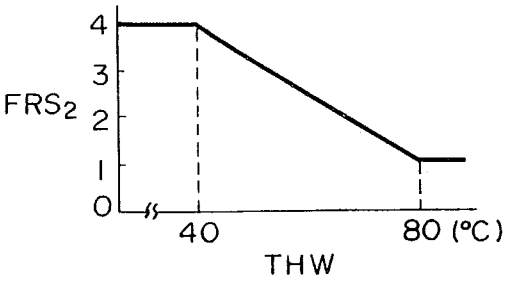
FIG. 7 is a graph of the second coefficient $FRS_2$ of the decrement factor versus the coolant temperature THW.

In the ROM 70 are stored beforehand routine programs for main processing an interrupt processing and various types of data which is necessary for carrying out arithmetic calculation, for example, map data or algebraic functions of first coefficient $FRS_1$ with respect to variation rate $\Delta(Q/Ne)$ of the volumetric efficiency shown in FIG. 6 and of second coefficient $FRS_2$ with respect to coolant temperature THW shown in FIG. 7.

Hereinafter, the operation of the microcomputer will be illustrated with reference to the flow diagrams of FIGS. 3, 4, and 5.

Figure 3:
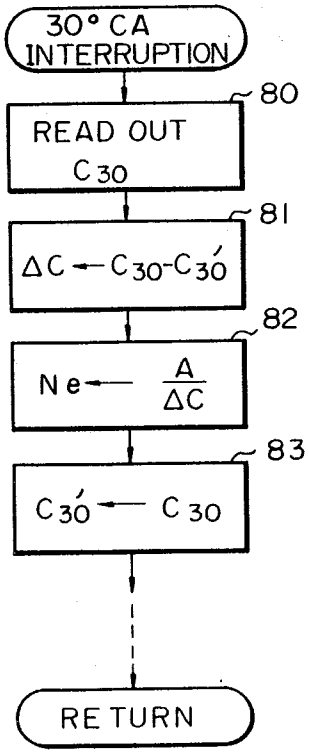

When the MPU 62 receives a pulse signal at every crank angle of 30° from the crank-angle sensor 42, the MPU 62 executes the interrupt-processing routine shown in FIG. 3 for producing rpm data which indicates actual rotational speed Ne of the engine.

At point 80, the contents in the free-run counter provided in the MPU 62 are read out and temporarily stored in the register in the MPU 62 as $C_{30}$. At point 81, the difference $\Delta C$ between contents $C_{30}$ of the free-run counter, which contents are read out in the present interruption cycle, and contents $C_{30}'$ in the free-run counter, which contents were read out in the last interruption cycle, is calculated from the equation $\Delta C = C_{30} - C_{30}'$. Then, at point 82, the reciprocal of the difference $\Delta C$ is calculated to obtain rotational speed Ne. Namely, at point 82, calculation of $Ne = (A/\Delta C)$ is excuted, where A is a constant. Calculated Ne is stored in the RAM 68. At point 83, contents $C_{30}$ in the present interruption cycle are stored in the RAM 68 as contents $C_{30}'$ of the free-run counter in the last interruption cycle and are used in the next interruption cycle. Thereafter, another process is executed in the interrupt-processing routine and then the program returns to the main-processing routine.

The MPU 62 further receives a binary signal which indicates intake-air flow rate Q and a binary signal which indicates coolant temperature THW from the A/D converter 60 in response to the interrupt request which occurs at every completion of A/D conversion. The MPU 62 stores the received binary signals in the RAM 68.

In a time-interrupt routine executed at intervals of a predetermined period of time, for example, at 4-msec intervals, the MPU 62 receives a binary signal which indicates vehicle-speed Nv and a binary signal of one bit produced by the neutral switch 54 from the I/O circuit 64 and stores the received binary signals in the RAM 68. The MPU 62 further receives the A/F signal produced by the comparator 63 from the I/O circuit 64 and forms a lean flag or a rich flag depending upon the A/F signal. This flag is used for calculating and A/F correction factor FAF in a processing routine which is not described in this specification. In the above time-interrupt routine, the MPU 62 forms a timer flag Ft which is set at "1" at t-msec intervals, for example, at 500-msec intervals. If t is 500-msec and the operation cycle of the time-interrupt routine is 4-msec. The timer flag Ft is set at "1" at every 125th operation cycle of the time-interrupt routine.

Figure 4A:
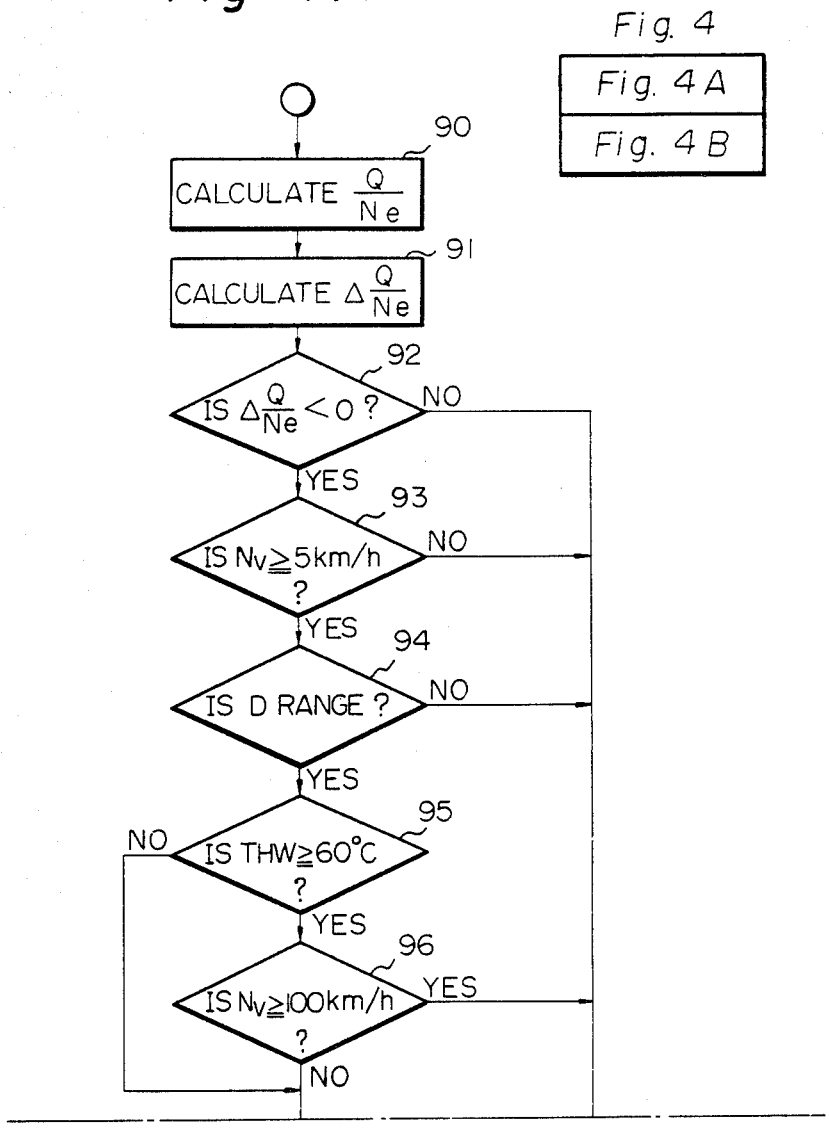
Figure 4B:
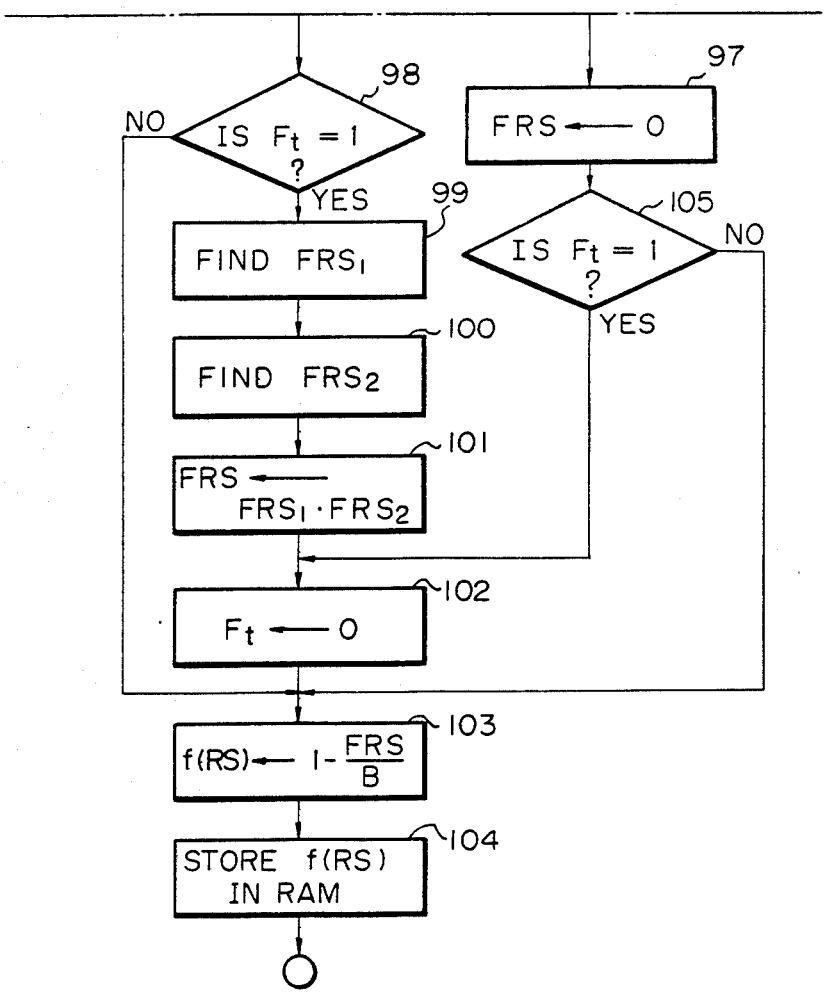

During the main processing routine, the MPU 62 executes the process shown in FIG. 4. First, at point 90, the MPU 62 reads out the data related to rotational speed Ne and to intake-air flow rate Q from the RAM 68 and calculates the volumetric efficiency Q/Ne of the engine. At point 91, the MPU 62 calculates the difference between the volumetric efficiency Q'/Ne which was calculated in the last operation cycle and the volumetric efficiency Q/Ne of the present operation cycle from the equation $$\Delta(Q/Ne)=(Q/Ne)-(Q'/Ne)$$

This difference Δ(Q/Ne) indicates the variation rate of the volumetric efficiency. At point 92, the MPU 62 discriminates whether or not the calculated variation rate ΔQ/Ne is lower than zero, namely whether ΔQ/Ne<0. This process at point 92 is to discriminate whether the engine is decelerating or not. If it is not decelerating (ΔQ/Ne≧0), the program proceeds to point 97, where a decrement tactor FRS is reset at zero.

If the engine is decelerating (ΔQ/Ne<0), the program proceeds to point 93 where the binary signal with respect to vehicle-speed Nv is read out from the RAM 68, and whether or not vehicle-speed Nv is higher than or equal to 5 km/h is discriminated. The program proceeds to point 94 only when Nv≧5 km/h. At point 94, whether or not the shift position of the automatic transmission is selected in the drive range (D-range) is discriminated depending upon one bit signal fed from the neutral switch 54 and stored in the RAM 68. The program proceeds to point 95 only when the shift position is selected in D-range. The above-mentioned process at points 92 to 94 checks whether fuel-decrement control during deceleration can be executed. Fuel-decrement control can be executed on the condition that (1) the volumetric efficiency Q/Ne is decreasing, (2) the vehicle-speed is equal to or above 5 km/h, and (3) the automatic transmission is selected in D-range. If the above condition is not satisfied, the program proceeds to point 97 where the decrement factor FRS is equalized to "0". Thus, in this case, fuel-decrement control is not executed.

The process at points 95 and 96 inhibits fuel-decrement control when the coolant temperature THW is higher than or equal to 60° C. and vehicle-speed Nv is higher than or equal to 100 km/h. If vehicle-speed Nv is high (Nv≧100 km/h), the intake-air flow rate Q is great and the variation rate ΔQ/Ne is accordingly great. Therefore, if fuel-decrement control is executed during a high vehicle-speed, the engine torque will be greatly changed, causing torque shock to occur during deceleration. In order to prevent torque shock from occurring, fuel-decrement control is inhibited when THW≧60° C., namely, when the engine is hot, and Nv≧100 km/h.

At point 98, the MPU 62 discriminates whether a timer flag Ft is "1" or not. If Ft="1", the process at points 99 to 102 is executed, but if Ft="0", the program jumps to point 103. According to the discrimination step at point 98, the process at points 99 to 101 for renewing the decrement factor FRS is executed at t-msec intervals.

At point 99, the MPU 62 finds a first coefficient $FRS_1$ in accordance with the variation rate ΔQ/Ne of the volumetric efficiency. The relationship between the first coefficient $FRS_1$ and the variation rate ΔQ/Ne as shown in FIG. 6 in the form of a $FRS_1$−Q/Ne map or algebraic functions is stored in the ROM 70 beforehand. As shown in FIG. 6, $FRS_1$ increases when ΔQ/Ne increases, but it ΔQ/Ne exceeds a certain value, $FRS_1$ is maintained at a constant value.

At point 100, the MPU 62 finds a second coefficient $FRS_2$ in accordance with the coolant temperature THW. The relationship between the second coefficient $FRS_2$ and the coolant temperature THW as shown in FIG. 7 in the form of a $FRS_2$-THW map or algebraic functions is stored in the ROM 70 beforehand, and $FRS_2$ decreases when THW increases.

At point 101, the decrement factor FRS is calculated from the equation.

$$FRS=FRS_1 \cdot FRS_2$$

Then the timer flag Ft is reset at "0" at point 102.

At point 103, a deceleration-correction factor f(RS) is calculated from the equation $$f(RS) = 1 - \frac{FRS}{B}$$

where B is a constant. Then the calculated deceleration-correction factor f(RS) is stored in the RAM 68 at point 104.

On the other hand, after the decrement factor FRS is reset at "0" at point 97, the program proceeds to point 105 where it is discriminated whether or not the timer flag Ft is "1". If Ft="1", the program proceeds to point 102 where the timer flag Ft is reset at "0". If Ft="0", the program proceeds to point 103. At point 103 in this case, the deceleration-correction factor f(RS) is determined as f(RS)=1.0 because FRS is zero.

Figure 5:
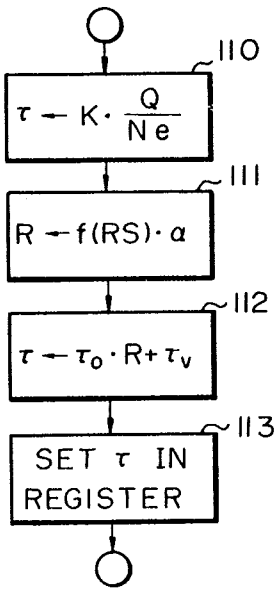

FIG. 5 illustrates a processing routine for calculating a fuel-injection pulse-width of $\tau$ in accordance with the deceleration-correction factor f(RS) calculated in the routine of FIG. 4.

During the main processing routine, the MPU 62 executes the process shown in FIG. 5. At point 110, the MPU 62 calculates the basic fuel-injection pulse width of $\tau o$ of the injection pulse fed to the fuel-injection valves 26, in accordance with the data related to the intake-air flow rate Q and the rotational speed Ne, which data is stored in the RAM 68, from the equation $$\tau o = K \cdot \frac{Q}{Ne}$$

where K is a constant. Then, at point 111, a total-correction factor R is calculated from the equation $$R=f(RS)\cdot\alpha$$

where f(RS) is the calculated deceleration-correction factor, and $\alpha$ is an another correction factor determined from, for example, the A/F correction factor, the warm-up enrichment factor, etc. At point 112, the MPU 62 calculates a pulse width of $\tau$ from the euqation $$\tau=\tau o\cdot R+\tau v$$

where $\tau v$ is a value that corresponds to the ineffective-injection pulse width of the fuel-injection valve 26. The data which corresponds to the thus-calculated pulse width of $\tau$ is set at point 113 in the aforementioned register in the I/o circuit 66. As a result, fuel is supplied to the engine at a feeding rate corresponding to the calculated pulse width of $\tau$.

According to the aforementioned system, if the condition for executing fuel-decrement control is satisfied, the fuel-feeding rate is decreased by a quantity depending upon the increase of the variation rate ΔQ/Ne of the volumetric efficiency which is equivalent to the engine load. In other words, the faster the engine load changes, the greater the decrease in the fuel-feeding rate. Therefore, fuel can always be supplied to the engine at an optimum feeding rate during deceleration. Furthermore, according to the aforementioned system, since the quantity of decrement of the fuel-feeding rate during deceleration is corrected in accordance with the warm-up condition of the engine, optimum fuel control during deceleration can be executed even when the engine is cold.

As mentioned hereinbefore in detail, according to the present invention, since the fuel-feeding rate during deceleration is controlled to an optimum value in response to the engine operating condition, both the fuel consumption during deceleration and engine response can be extremely improved.

As many widely different embodiments of the present invention may be constructed without departing from the spirit and scope of the present invention, it should be understood that the present invention is not limited to the specific embodiments described in this specification, except as defined in the appended claims.

We claim:

1. A method for controlling the fuel-feeding rate of an internal combustion engine which is mounted on a vehicle, comprising the steps of:

detecting whether the engine is decelerating or not to generate a first electrical signal which indicates the detected result;

detecting the variation rate of the load of the engine to generate a second electrical signal which indicates the detected variation rate of the engine load;

detecting the running speed of the vehicle to generate a third electrical signal which indicates the detected vehicle speed;

changing the feeding rate of fuel supplied to the engine by a quantity depending upon said second electrical signal when said first electrical signal indicates that the engine is deceleration; and stopping the change of the fuel-feeding rate depending upon said second electrical signal when said third electrical signal indicates that the vehicle-speed is slower than a predetermined low speed, wherein said method further comprises the step of:

stopping the change of the fuel-feeding rate depending upon said second electrical signal when said third electrical signal indicates that the vehicle-speed is higher than a predetermined high speed.

2. A method as claimed in claim 1, wherein said changing step includes a step of decreasing the fuel-feeding rate by a quantity depending upon said second electrical signal so that the smaller the variation rate of the engine load, the smaller the quantity of decrement of the feeding rate of the fuel.

3. A method as claimed in claim 1, wherein said method further comprises a step of detecting the warm-up condition of the engine to generate a fourth electrical signal which indicates the detected warm-up condition, and said changing step includes a step of changing the fuel-feeding rate by a quantity depending upon said second and fourth electrical signals when said first electrical signal indicates that the engine is decelerating.

4. A method as claimed in claim 3, wherein said changing step includes a step of decreasing the fuel-feeding rate by a quantity depending upon said second and fourth electrical singnals so that the smaller the variation rate of the engine load, the smaller the quantity of decrement of the fuel-feeding rate and the warmer the engine condition, the smaller the quantity of decrement of the fuel-feeding rate.

5. A method as claimed in claim 1, wherein said engine is connected to an automatic transmission, and said method further comprises the steps of:

detecting whether or not the shifted position of the automatic transmission is a drive range position to generate a fifth electrical signal which indicates the detected result; and stopping the change of the fuel-feeding rate depending upon said second electrical signal when said fifth electrical signal indicates that the shifted position is not the drive range position.

6. A method as claimed in claim 1, wherein said step of detecting the variation rate includes the steps of:

detecting the flow rate of intake air supplied to the engine to generate a sixth electrical signal which indicates the detected intake-air flow rate;

detecting the rotational speed of the engine to generate a seventh electrical signal which indicates the detected rotational speed;

calculating, in accordance with said sixth and seventh electrical signals, the volumetric efficiency of the engine to generate an eighth electrical signal which indicates the calculated volumetric efficiency; and calculating, in response to said eighth electrical signal, the variation of volumetric efficiency with respect to time so as to obtain the variation rate of the engine load.

7. A method as claimed in claim 6, wherein said decelerating-detecting step includes a step of detecting whether the volumetric efficiency decreases or not.

8. An apparatus for controlling the fuel-feeding rate of an internal combustion engine which is mounted on a vehicle, comprising:

means for detecting whether the engine is decelerating or not to generate a first electrical signal which indicates the detected result;

means for detecting the variation rate of the load of the engine to generate a second electrical signal which indicates the detected variation rate of the engine load;

means for detecting the running speed of the vehicle to generate a third electrical signal which indicates the detected vehicle-speed;

means for changing the feeding rate of fuel supplied to the engine by a quantity depending upon said second electrical signal when said first electrical signal indicates that the engine is deceleration; and means for stopping the change of the fuel-feeding rate depending upon said second electrical signal when said third electrical signal indicates that the vehicle-speed is slower than a predetermined low speed, wherein said apparatus further comprises:

means for stopping the change of the fuel-feeding rate depending upon said second electrical signal when said third electrical signal indicates that the vehicle-speed is higher than a predetermined high speed.

9. An apparatus as claimed in claim 8, wherein said changing means includes means for decreasing the fuel-feeding rate by a quantity depending upon said second electrical singnal so that the smaller the variation rate of the engine load, the smaller the quantity of decrement of the feeding rate of the fuel.

10. An apparatus as claimed in claim 8, wherein said apparatus further comprises means for detecting the warm-up condition of the engine to generate a fourth electrical signal which indicates the detected warm-up condition, and said changing means includes means for changing the fuel-feeding rate by a quantity depending upon said second and fourth electrical signals when said first electrical signal indicates that the engine is decelerating.

11. An apparatus as claimed in claim 10, wherein said changing means includes means for decreasing the fuel-feeding rate by a quantity depending upon said second and fourth electrical signals so that the smaller the variation rate of the engine load, the smaller the quantity of decrement of the fuel-feeding rate and the warmer the engine condition, the smaller the quantity of decrement of the fuel-feeding rate.

12. An apparatus as claimed in claim 8, wherein said engine is connected to an automatic transmission, and said apparatus further comprises:

means for detecting whether or not the shifted position of the automatic transmission is a drive range position to generate a fifth electrical signal which indicates the detected result; and means for stopping the change of the fuel-feeling rate depending upon said second electrical signal when said fifth electrical signal indicates that the shifted position is not the drive range position.

13. An apparatus as claimed in claim 8, wherein said means for detecting the variation rate includes:

means for detecting the flow rate of intake air supplied to the engine to generate a sixth electrical signal which indicates the detected intake-air flow rate;

means for detecting the rotational speed of the engine to generate a seventh electrical signal which indicates the detected rotational speed;

means for calculating, in accordance with said sixth and seventh electrical signals, the volumetric efficiency of the engine to generate an eighth electrical signal which indicates the calculated volumetric efficiency; and means for calculating, in response to said eigth electrical signal, the variation of volumetric efficiency with respect to time so as to obtain the variation rate of the engine load.

14. An apparatus as claimed in claim 13, wherein said deccelerating-detecting means includes means for detecting whether the volumetric efficiency decreases or not.

* * * * *